US006629916B2

(12) United States Patent
Vijuk et al.

(10) Patent No.: US 6,629,916 B2
(45) **Date of Patent: *Oct. 7, 2003**

(54) SHEET FEED DEVICE FOR LEAFLET FOLDER

(75) Inventors: Joseph M. Vijuk, Oak Brook, IL (US); Robert Vijuk, Downers Grove, IL (US)

(73) Assignee: Vijuk Equipment, Inc., Elmhurst, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/898,609

(22) Filed: Jul. 6, 2001

(65) Prior Publication Data

US 2002/0032108 A1 Mar. 14, 2002

Related U.S. Application Data

(63) Continuation of application No. 09/579,870, filed on May 26, 2000, now Pat. No. 6,257,568, which is a continuation of application No. 09/047,716, filed on Mar. 25, 1998, now Pat. No. 6,095,512.

(51) Int. Cl.[7] ..... B31B 1/36

(52) U.S. Cl. ..... 493/81; 493/13; 493/17; 493/147; 493/27

(58) Field of Search ..... 493/23, 13, 15, 493/17, 81, 147, 180, 27, 25

(56) References Cited

U.S. PATENT DOCUMENTS

| | | | | |
|---|---|---|---|---|
| 3,044,767 A | | 7/1962 | Winkler et al. | 271/2 |
| 3,599,965 A | | 8/1971 | Humphrey et al. | 271/30.6 |
| 3,871,644 A | * | 3/1975 | Stobb | |
| 4,018,434 A | | 4/1977 | Mitchell et al. | 271/96 |
| 4,381,108 A | * | 4/1983 | Newsome | |
| 4,436,297 A | | 3/1984 | Chandhoke | 271/30.5 |
| 4,524,963 A | | 6/1985 | D'Angelo et al. | 271/3.12 |
| 4,579,330 A | | 4/1986 | Lehmann | 271/11 |
| 4,585,221 A | * | 4/1986 | Lillibridge | |
| 4,616,815 A | | 10/1986 | Vijuk | 270/45 |
| 4,771,896 A | | 9/1988 | Newsome | 271/30.7 X |
| 4,850,583 A | | 7/1989 | Monday | 271/240 |
| 5,121,914 A | * | 6/1992 | Hargreaves | |
| 5,150,891 A | | 9/1992 | Svyatsky et al. | 271/35 |
| 5,197,726 A | | 3/1993 | Nogami | 271/110 |
| 5,242,364 A | * | 9/1993 | Lehmann | 493/15 |
| 5,295,678 A | * | 3/1994 | Lindner et al. | |
| 5,456,573 A | * | 10/1995 | Morris et al. | |
| 5,465,949 A | | 11/1995 | Yamada et al. | 271/110 |
| 5,542,349 A | * | 8/1996 | Gosslinghoff | |
| 5,575,463 A | * | 11/1996 | Parkander | |
| 5,575,466 A | | 11/1996 | Tranquilla | 271/10.03 |
| 5,622,364 A | * | 4/1997 | Dutton et al. | |
| 6,095,512 A | * | 8/2000 | Vijuk et al. | |
| 6,257,568 B1 | * | 7/2001 | Vijuk et al. | |

* cited by examiner

*Primary Examiner*—Eugene Kim
*Assistant Examiner*—Sameh Tawfik
(74) *Attorney, Agent, or Firm*—Marshall, Gerstein & Borun

(57) ABSTRACT

An apparatus adapted to be used for the automatic handling of sheets from which leaflets are formed and which includes a transfer unit for conveying sheets, an accumulator station disposed adjacent the transfer unit and being adapted to receive sheets from the transfer unit and to accumulate the sheets in a stack, a sensor associated with the accumulator station and being adapted to generate a signal indicative of whether the height of the stack of sheets in the accumulator station is at least equal to a minimum height, a sheet feeder adapted to periodically remove sheets from the stack of sheets at a substantially constant rate and a control mechanism operatively coupled to the sensor and the sheet feeder. The control mechanism is adapted to cause the sheet feeder to remove the sheets from the accumulator station as long as the height of the stack of sheets is at least the minimum height as determined by the sensor, and the control mechanism is adapted to cause the sheet feeder to cease removal of the sheets from the accumulator station if the height of the stack of sheets falls below the minimum height as determined by the sensor.

22 Claims, 4 Drawing Sheets

SHEET FEED DEVICE FOR LEAFLET FOLDER

This appln is a con't of Ser. No. 09/579,870 filed May 26, 2000 U.S. Pat. No. 6,257,568 which is a con't of Ser. No. 09/047,716 filed Mar. 25, 1998, U.S. Pat. No. 6,095,512.

BACKGROUND OF THE INVENTION

The invention is directed to an apparatus adapted to be used for the automatic transfer of sheets from which leaflets are formed from a printing press to a folder.

Leaflets may be formed by printing a paper web with printed subject matter, separating the web into individual sheets, transferring the individual sheets to a folder, and then folding the individual sheets into leaflets. As disclosed in U.S. Pat. No. 4,616,815 to Michael Vijuk, printed and cut shingled sheets were previously transferred manually from a web printing press to an automatic folding machine used for folding the sheets to form leaflets. The invention disclosed in that Vijuk patent is advantageous in that allows the previously manual transfer of sheets to be automated, which is particularly advantageous in view of the relatively high output of sheets from a web printing press, which may be on the order of 40,000 sheets per hour or more.

As shown in FIG. 1, the Vijuk patent discloses a printing press 15 which applies printed subject matter to a paper web and cuts the paper web into individual sheets to generate a shingled stream of sheets. The sheets are conveyed by a sheet transfer conveyor 16 to a stacking station 18 where sheets may accumulate in a vertical stack. Sheets are periodically removed from the bottom of the stack of sheets at the stacking station 18 by a rotatable vacuum cylinder 40 (shown in FIG. 6) and transferred to an alignment conveyor 22 for subsequent transfer to a folding station 14.

A prior art apparatus for automatically transferring sheets from a web printer to a folding machine generally in accordance with the disclosure of the Vijuk patent controlled the vacuum cylinder so that its rotational speed varied in response to the height of the stack of sheets in the stacking station, with the height of the stack of sheets being detected by a sensor positioned adjacent the stack. The prior art apparatus also included a sensor for sensing whether the height of the stack of sheets was below a minimum height. In that case, a visual message would be displayed to prompt the operator to place additional sheets in the stack at the stacking station. The prior art apparatus also controlled when a vacuum was provided to the interior of the vacuum cylinder was selectively opening and closing a pneumatic valve that fluidly coupled the vacuum cylinder to a vacuum pump.

The prior art apparatus described above included a batch control module that allowed the operator to input a desired number of sheets which was to be transferred as a batch, along with a desired time delay between batches of sheets. The prior art apparatus also included a rate control module that allowed the operator to input a desired distance or gap between adjacent sheets as they are fed by the vacuum cylinder, as well as the time duration for which the pneumatic valve was opened and closed. Based upon those parameters entered by the operator, the batch control module and rate control module controlled the time periods when the pneumatic valve was on and off, and thus the removal of the sheets from the stack by the vacuum cylinder.

SUMMARY OF THE INVENTION

In one aspect, the invention is directed to an apparatus adapted to be used for the automatic handling of sheets from which leaflets are formed, said apparatus comprising: a transfer unit for conveying sheets; an accumulator station disposed adjacent said transfer unit, said accumulator station being adapted to receive sheets from said transfer unit and to accumulate said sheets in a stack; a sensor associated with said accumulator station, said sensor being adapted to generate a signal indicative of whether the height of said stack of sheets in said accumulator station is at least a minimum height; a sheet feeder being adapted to periodically remove sheets from said stack of sheets, said sheet feeder comprising: a rotatable vacuum roll adapted to remove a sheet from the bottom of said stack of sheets at said accumulator station; a vacuum generator operatively coupled to said vacuum roll for creating a suction pressure within an interior portion of said vacuum roll; and a motor for causing said vacuum roll to be rotatably driven; and a control mechanism operatively coupled to said sensor and said sheet feeder, said control mechanism being adapted to cause said sheet feeder to remove said sheets from said accumulator station as long as the height of said stack of sheets is at least said minimum height as determined by said sensor, said control mechanism being adapted to cause said sheet feeder to cease removal of said sheets from said accumulator station if the height of said stack of sheets falls below said minimum height as determined by said sensor.

These and other features of the present invention will be apparent to those of ordinary skill in the art in view of the detailed description of the preferred embodiment, which is made with reference to the drawings, a brief description of which is provided below.

DETAILED DESCRIPTION OF THE PREFERRED EMBODIMENTS

Figure 1:
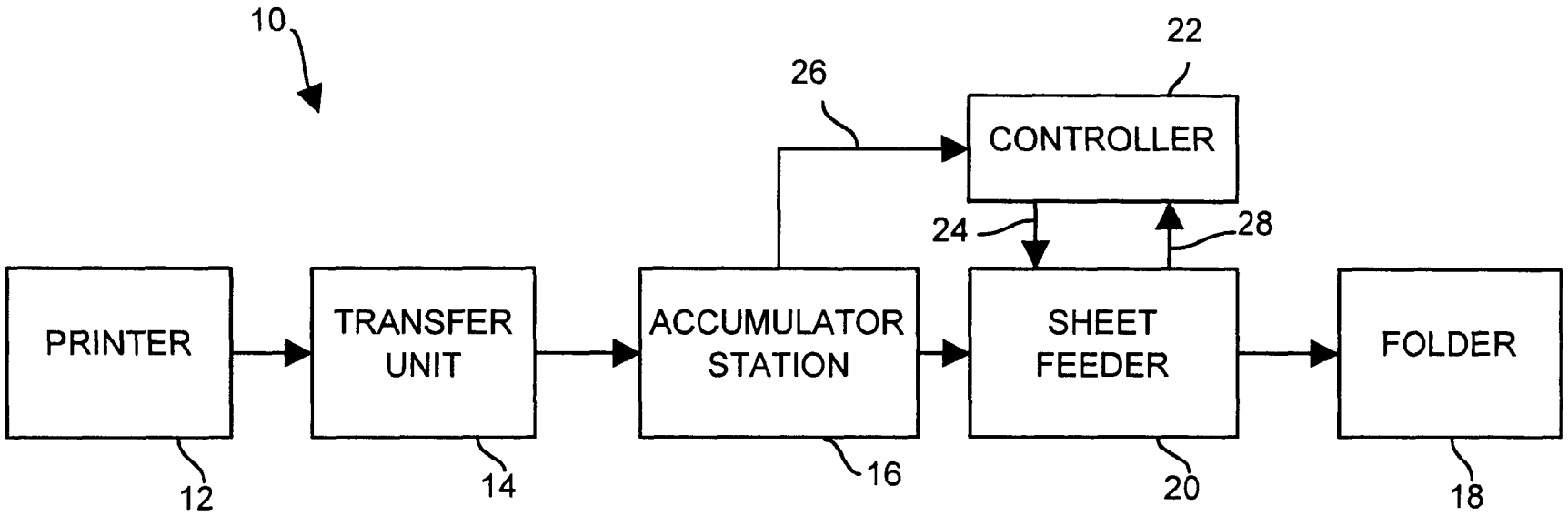
FIG. 1 is a block diagram of a leaflet fabrication system in which the invention is incorporated.

A block diagram of a leaflet fabrication system 10 in which the present invention is incorporated is shown in FIG. 1. The leaflets fabricated by the system 10, which may be in the form of outserts for example, are generally paper products having printed subject matter thereon with at least one fold.

Referring to FIG. 1, the leaflet fabrication system 10 includes a printer 12, which may be in the form of a web printer that prints textual subject matter on a paper web (not shown) provided to the printer 12 and cuts the paper web into individual sheets after it is printed. The printer 12, which may also make one or more folds in the individual sheets, produces a stream of printed sheets which are provided to a sheet transfer unit 14. The stream of sheets may be in the form of a shingled stream, in which case the sheets are overlapping each other in a conventional manner. Each of the sheets in the stream may be unfolded, or may have one or more folds formed therein.

The transfer unit 14 acts to transfer the sheets to an accumulator station 16, at which the sheets may temporarily accumulate in a stack of sheets, before being provided to a folding machine 18 via an automatic sheet feeder 20. The accumulator station 16 may be designed to accumulate sheets due to relatively small differences in the sheet processing capacity between the printer 12 and the automatic folder 18. The operation of the sheet feeder 20 is controlled by a controller 22 via a control line 24, based on electronic input signals input to the controller 22 via a number of lines 26, 28.

Figure 2:
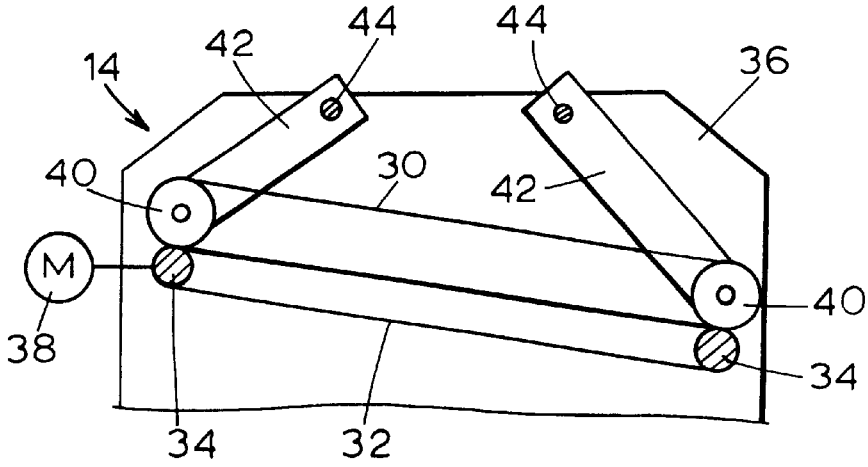
FIG. 2 is a side view of the transfer unit shown schematically in FIG. 1.

FIG. 2 is a side view of a portion of the sheet transfer unit 14 shown schematically in FIG. 1. Referring to FIG. 2, the transfer unit 14 has a plurality of upper conveyor belts 30 and lower conveyor belts 32 between which the stream of sheets from the printer 12 passes. The lower belts 32, which may be in the form of flat belts composed of fabric having a non-slip coating, are supported by a plurality of rotatable metal rods 34 supported by a pair of frame members 36 (only one of which is shown), at least one of the rods 34 being rotatably driven by a motor shown schematically at 38.

The upper belts 30, which may be composed of rubber and which may have a circular cross section, are supported by a plurality of rollers 40, each of which is rotatably supported by a respective pivot arm 42 connected to one of a pair of pivot rods 44 supported between the frame members 36. The upper belts 30 may be sized so that, when they are placed onto the rollers 40, the tension of the upper belts 30 forces the pivot arms 42 downwards so that the upper belts 30 and the lower belts 32 make sufficiently firm contact with the stream of sheets to ensure that the sheets do not move relative to one another as they are transferred from the printer 12 to the accumulator station 16 by the transfer unit 14.

Figure 3:
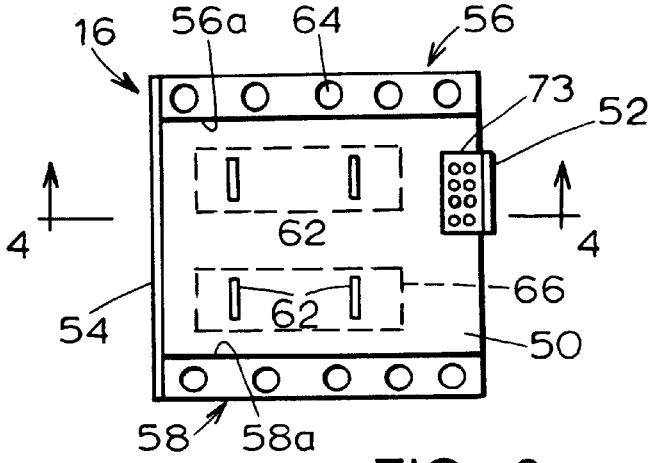
FIG. 3 is a top view of the accumulator station shown schematically in FIG. 1.
Figure 4:
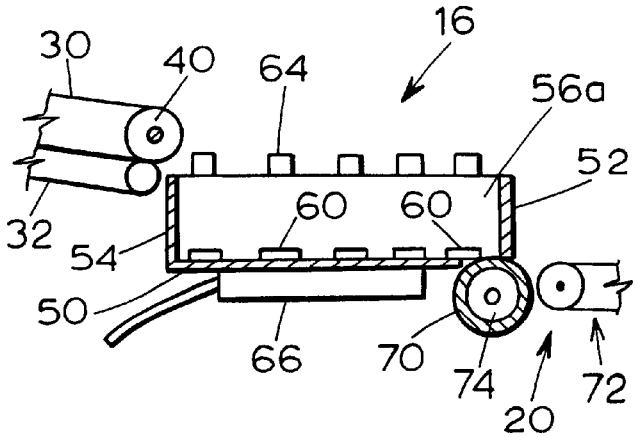
FIG. 4 is a cross-sectional side view of the accumulator station taken along lines 4—4 of FIG. 3.

FIGS. 3 and 4 illustrate the basic structure of the accumulator station 16 shown schematically in FIG. 1. Referring to FIGS. 3 and 4, the accumulator station 16 has a flat base plate 50, a front plate 52, a rear wall 54, and a pair of elongate hexahedral side members 56, 58 each having a respective inner side surface 56*a*, 58*a*. As shown in FIG. 4, the upper and lower conveyor belts 30, 32 of the transfer unit 14 are positioned so as to deposit sheets into the hexahedral space defined by the base plate 50, the front plate 52, the rear wall 54, and the side surfaces 56*a*, 58*a*.

Figure 7A:
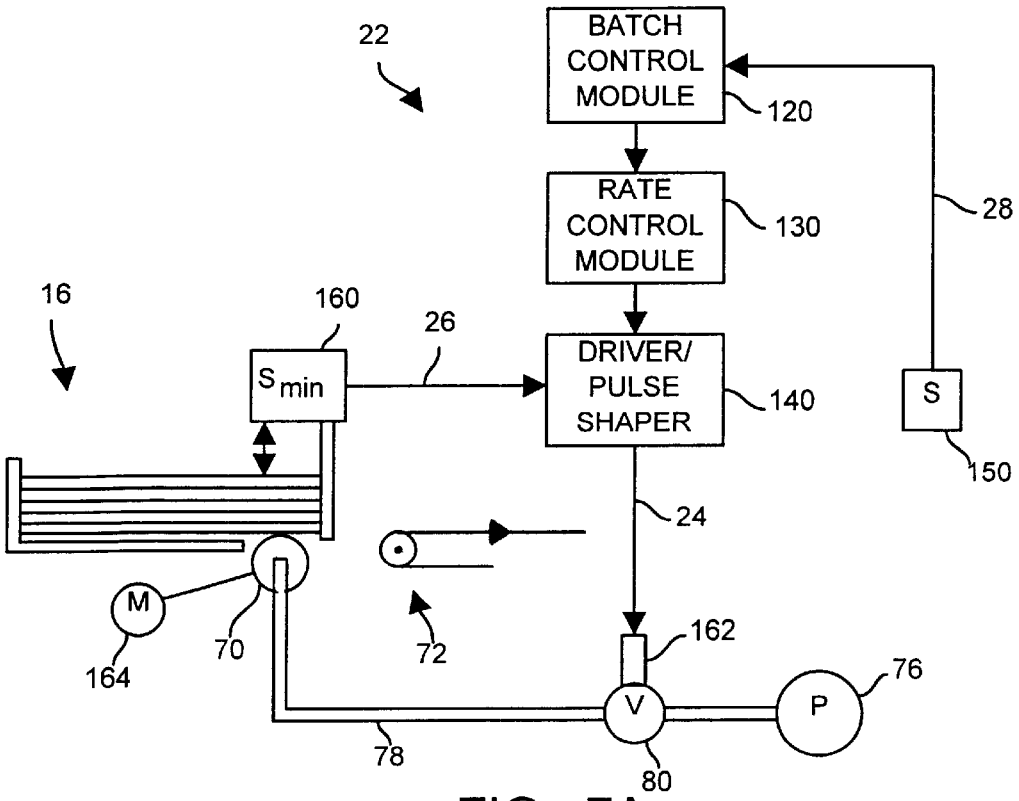
FIG. 7A is a block diagram illustrating a first embodiment of the controller shown schematically in FIG. 1 and portions of the accumulator station and the sheet feeder.
Figure 7B:
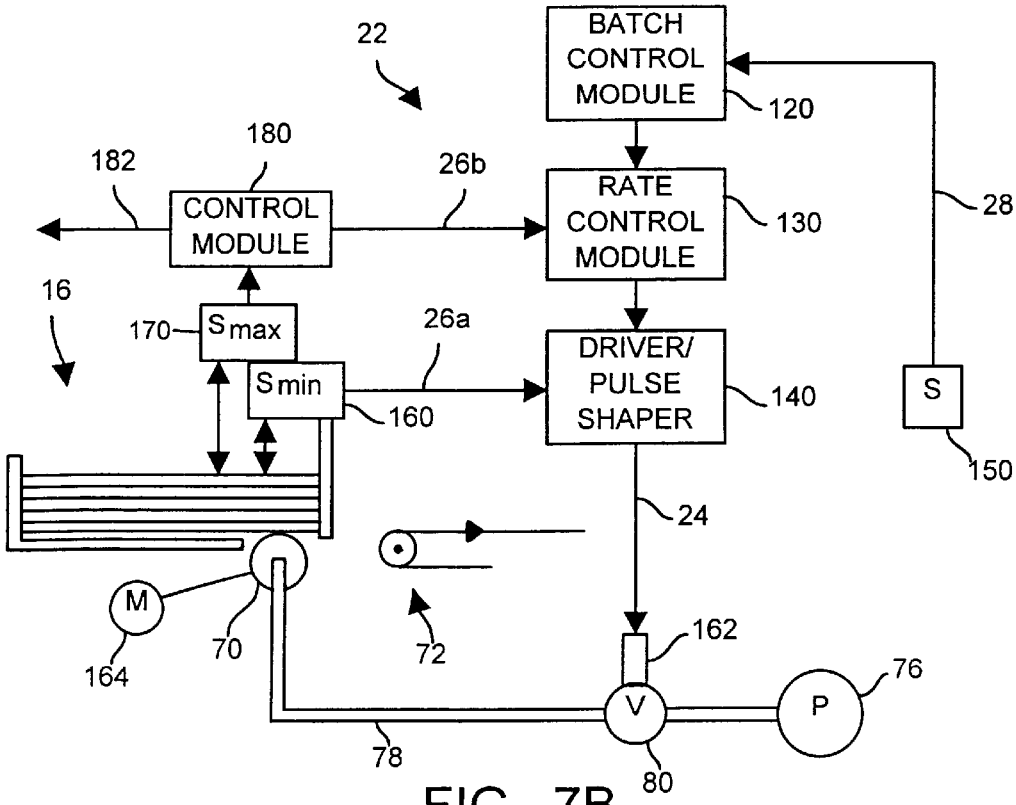
FIG. 7B is a block diagram illustrating a second embodiment of the controller shown schematically in FIG. 1 and portions of the accumulator station and the sheet feeder.

Pressurized air is forced against the lower portion of the stack of sheets in the accumulator station 16 in a conventional manner to slightly levitate the lowermost sheets (as shown in FIGS. 7A and 7B) to reduce the coefficient of friction between the lowermost sheet in the stack and the base plate 50 and to provide slight physical separation between the lowermost sheets in the stack. The pressurized air is provided by a number of apertures 60 formed in each of the inner side surfaces 56*a*, 58*a* and a number of apertures 62 formed in the base plate 50.

The side members 56, 58, which act as pneumatic pressure manifolds, have a hollow interior which is divided into a number of individual pressure compartments, each of which is pneumatically coupled to a source of pressurized air (not shown) and to a respective one of the apertures 60 in the side surfaces 56*a*, 58*a*. The pressure of the air provided through each aperture 60 may be varied by a respective regulator knob 64 associated with each of the pressure compartments by an internal valve structure shown and described in U.S. Pat. No. 4,616,815 to Michael Vijuk, the disclosure of which is incorporated herein by reference. Pressurized air may be provided to the apertures 62 formed in the base plate 50 via one or more pressure manifolds 66 disposed beneath the base plate 50. Pressurized air may also be provided through a number of apertures (not shown) formed in the rear wall 54. The particular mechanical design of the accumulator station 16 described above is not considered important to the invention, and other designs could be used. Sheet transfer units, accumulator stations, and automatic folding machines of the type described above are commercially available from Vijuk Equipment Co. of Elmhurst, Ill.

Figure 5:
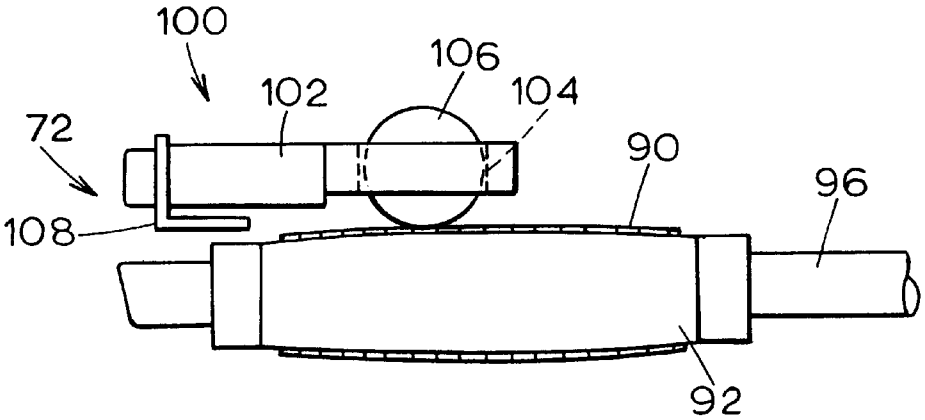
FIG. 5 is a side view of a portion of the sheet feeder shown schematically in FIG. 1.
Figure 6:
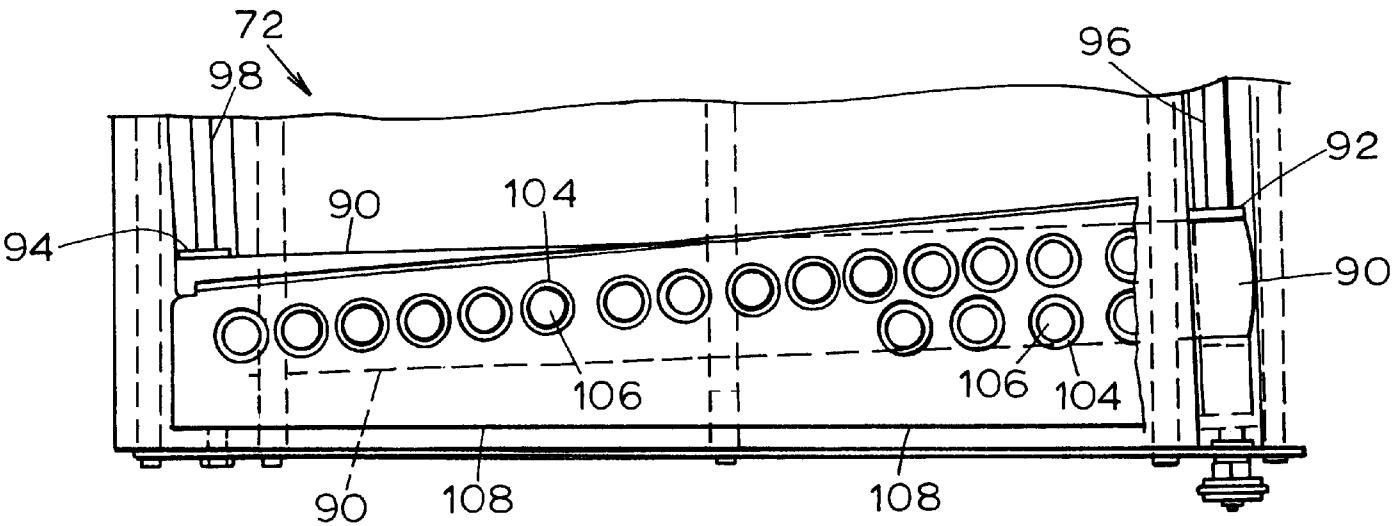
FIG. 6 is a top view of a portion of the sheet feeder of FIG. 5.

FIGS. 4, 5 and 6 illustrate the sheet feeder 20 shown schematically in FIG. 1. Referring to FIG. 4, the sheet feeder 20 has a first part in the form of a vacuum drum or roll 70 and a second part in the form of a conveyor 72. The vacuum roll 70, which is controlled to periodically remove the lowermost sheet from the bottom of the stack of sheets, is provided in the form of a hollow cylindrical drum having a plurality of holes formed in its cylindrical outer surface and is positioned directly beneath a rectangular aperture 73 formed in the base plate 50. The vacuum roll 70 has a hollow interior portion 74 in which a reduced or suction pressure may be selectively provided. To that end, the interior of the vacuum roll 70 is pneumatically coupled to a vacuum pump 76 (FIGS. 7A and 7B) via a pneumatic line 78 and a pneumatic valve 80 that is adapted to selectively open and close the pneumatic line 78.

FIGS. 5 and 6 illustrate the structure of the conveyor 72 shown schematically in FIG. 4. Referring to FIGS. 5 and 6, the conveyor 72 has a conveyor belt 90 driven by a pair of spaced rollers 92, 94 each of which is rotatably driven by a respective drive rod 96, 98. The conveyor 72 also includes a sheet alignment mechanism 100 positioned directly over the conveyor belt 90. The alignment mechanism 100 includes a retainer arm 102 having a plurality of cylindrical bores 104 formed therein, a respective metal ball 106 disposed within each of the bores 104, and an L-shaped side guide 108 connected to the retainer arm 102.

Sheets from the accumulator station 16 are periodically and individually fed by the vacuum roll 70 to the conveyor 72 so that they pass between the bottom of the metal balls 106 and the top of the conveyor belt 90. The weight of the metal balls 106 resting on top of the sheets maintains the alignment of the sheets relative to the conveyor belt 90. As shown in FIG. 6, the side guide 108 is angled slightly relative to the conveyor belt 90. Consequently, as the sheets pass through the conveyor 72 (from right to left in FIG. 6), the side edges of the sheets are gradually moved against the edge of the side guide 108, which movement causes the side edges of the sheets to become justified or flush against the side guide 108 for proper alignment as the sheets enter the automatic folding machine 18.

FIG. 7A illustrates a first embodiment of the controller 22 shown schematically in FIG. 1 and the mechanical components with which the controller 22 interfaces. Referring to FIG. 7A, the first embodiment of the controller 22 includes a batch control module 120, a rate control module 130, and a driver circuit 140, which may optionally include a pulse-shaping circuit. Sheets may be fed from the accumulator station 16 to the folder 18 in batches, such as in batches of 200 sheets for example, with a predetermined time delay, e.g. 10 seconds, between batches. The batch control module 120, which may be a conventional module such as Model MCS-106 manufactured by Sutron Electronic, allows the operator to input the desired number of sheets in each batch and the desired time delay between batches.

The batch control module 120 is operatively connected to a conventional sheet sensor 150, which counts the sheets prior to the sheets being fed into the folder 18. Based upon sheet detection signals generated by the sheet sensor 150, the batch control module 120 is able to determine the number of sheets fed to the printer 18, and thus when a complete batch of the desired number of sheets has been fed to the printer 18. At the completion of each batch of sheets, the batch control module 120 causes the desired time delay between successive batches to be waited.

The rate control module 130 allows the operator to input the desired time duration or spacing between adjacent sheets, and the desired time duration for which the suction pressure is to be provided to the interior of the vacuum roll 70, and the rate control module 130 causes the pneumatic valve 80 to be turned on and off in accordance with those time durations to selectively apply the suction pressure to the vacuum roll 70. It should be noted that the time duration between adjacent sheets entered by the operator affects the rate at which sheets are fed by the vacuum roll 70, with a longer time duration corresponding to a lower feed rate. The rate control module 130 is a conventional control module, such as a Model SAF36 STE+SAF36P−1 LS manufactured by Rieger Electronik.

The drive circuit 140 is connected to a sensor 160 via the line 26. The sensor 160, which may be a conventional sensor such as Model E3S-LS 10×B4 manufactured by Omron, detects whether or not the height of the stack of sheets in the accumulator station 16 is at least equal to a predetermined minimum height. The drive circuit 140 is also connected to a valve actuator 162 that opens and closes the pneumatic valve 80 in response to signals provided to the valve actuator 162 via the line 24.

Still referring to FIG. 7A, the vacuum roll 70 is rotated at a substantially constant rate during operation by a motor 164, and the periodic removal of sheets from the accumulator station 16 by the vacuum roll 70 is controlled by selectively turning on and off the suction pressure within the vacuum roll 70. To provide suction pressure to the vacuum roll 70, the pneumatic valve 80 is opened, via the valve actuator 162, so that the vacuum pump 76 sucks air through the holes formed in the outer cylindrical portion of the vacuum roll 70 and through the pneumatic line 78. When the pneumatic valve 80 is closed, the suction pressure is eliminated since the vacuum pump 76 is no longer pneumatically connected to the interior of the vacuum roll 70 and since the interior of the vacuum roll 70 is vented to the atmosphere via the holes formed in its outer cylindrical surface.

During operation, while the vacuum roll 70 rotates at a substantially constant rate, the suction pressure within the vacuum roll 70 is turned on for the time duration previously specified by the operator via the rate control module 130, and then turned off, to cause a single sheet to be removed from the bottom of the stack of sheets in the accumulator station 16 by the rotating vacuum roll 70 and then transferred to the conveyor 72. After the "between-sheet" time duration or delay previously specified by the operator via the rate control module 130 elapses, the suction pressure is again turned on and off, with the vacuum roll 70 continuing to rotate at its constant rate, so that the next sheet is fed. That process continues until an entire batch of sheets is fed, and then is temporarily interrupted for a time equal to the "between-batch" time duration or delay previously specified by the operator via the batch control module 120.

As long as the height of the stack of sheets in the accumulator station 16 is at least the minimum height as determined by the sensor 160, the above periodic feeding process continues uninterrupted. However, if at any time the height of the stack of sheets is shorter than the minimum height, the sensor 160 transmits a temporary shutoff signal to the drive circuit 140 via the line 26, which causes the drive circuit 140 to temporarily close the valve 80, via the actuator 162, for a predetermined minimum time period, to temporarily stop the removal of sheets from the accumulator station 16. Thus, the temporary shutoff signal generated by the sensor 160 acts as an override signal that prevents the drive circuit 140 from operating the valve actuator 162 in accordance with the control signal provided to the drive circuit 140 by the rate control module 130.

The vacuum roll 70 can be considered to have two states of operation, a normal or "on" state in which the vacuum roll 70 periodically removes sheets from the bottom of the stack, and an override or "off" state (triggered by the sensor 160) in which the normal periodic removal of sheets by the vacuum roll 70 is interrupted.

The drive circuit 140 may include a pulse-shaping circuit (such as a Model CPF11 pulse lengthener manufactured by Comat) that is designed to limit the rate at which the vacuum roll 70 transitions between the "on" state and the "off" state. Limiting the transition rate is accomplished by causing the vacuum roll 70 to cease removal of sheets from the accumulator station 16 for a minimum period of time after the height of the stack of sheets falls below minimum height as determined by the sensor 160. After that minimum period of time elapses, the vacuum roll 70 is returned to its normal or on state of operation, providing that the height of the stack of sheets is at least the minimum height as determined by the sensor 160.

As an example, if the height of the stack of sheets falls below the minimum height for only a very short period of time, for example 0.010 seconds, the pulse-shaping circuit increases the duration of the shutoff signal to a minimum duration, such as 0.400 seconds. This is done to prevent short-term cycling of the suction pressure, which is undesirable since the suction pressure within the vacuum roll 70 cannot be turned on and off as quickly as the sensor 160 can sense variation in the height of the stack of sheets in the accumulator station 16.

Temporarily interrupting the normal feeding of sheets to maintain a minimum level of sheets is advantageous in the context of a stack of sheets which is pneumatically levitated, as described above, since if the height of the stack falls significantly below the minimum level, sheets may be blown out of the accumulator station 16 by the force of the pressurized air used to levitate the stack. The minimum height of the stack, which depends upon various factors including the weight of the paper being used and the amount of air pressure used to levitate the stack, may be on the order of 0.375 of an inch, for example.

FIG. 7B illustrates a second embodiment of the controller 22 shown schematically in FIG. 1. The embodiment shown in FIG. 7B is substantially the same as shown in FIG. 7A, except that the embodiment of FIG. 7B additionally includes a sensor 170 connected to a control module 180, which generates a number of output signals via lines 26*b* and 182 (line 26*a* of FIG. 7B corresponds to line 26 of FIG. 7A).

Referring to FIG. 7B, the sensor 170, which may be a conventional sensor such as a Model WT27-P610 manufactured by Sick Optic Electronic, generates a signal indicative of whether the height of the stack of sheets in the accumulator station 16 is at least a maximum height. Two possible control actions may be taken if the height of the stack reaches or exceeds the maximum height. First, the line 182 may be operatively connected to the printer 12 (FIG. 1) to alter the rate at which the printer 12 is producing sheets, for example, by lowering the rate or by temporarily stopping the printer 12. Second, in response to the sensor 170 detecting that the height of the stack reaches or exceeds the maximum height, the control module 180 may generate a signal on the line 26*b* to cause the between-batch gap or delay selected by the operator via the batch control module 120 to be shortened to reduce that the height of the stack of sheets at the accumulator station 16.

The control module 180 could be provided in the form of a relay having a first position if the stack was below the maximum height and a second position if the stack exceeded the maximum height. If both functions described above for the sensor 170 were utilized, the control module 180 could effectively include two relays, one for each of the output lines 26*b*, 182.

The sensors 160, 170 described above could detect the minimum and maximum height of the stack of sheets in various ways. For example, whether or not the height of the stack was lower than the minimum or greater than the maximum could be detected by detecting the actual height of the stack, or alternatively by detecting the distance between the top of the stack and the sensor.

Numerous modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. An apparatus adapted to be used for the automatic handling of sheets from which leaflets are formed, said apparatus comprising:

a transfer unit for conveying sheets;

an accumulator station disposed adjacent said transfer unit, said accumulator station being adapted to receive sheets from said transfer unit and to accumulate said sheets in a stack, said accumulator station comprising a plurality of air-pressure apertures to supply pressurized air against a portion of said stack of sheets;

a sensor associated with said accumulator station, said sensor being adapted to generate a signal indicative of whether the height of said stack of sheets in said accumulator station is at least a minimum height;

a sheet feeder being adapted to periodically remove sheets from said stack of sheets, said sheet feeder being adapted to remove sheets from said stack of sheets at a substantially constant rate, said sheet feeder comprising:

a rotatable vacuum roll adapted to remove a sheet from the bottom of said stack of sheets at said accumulator station;

a vacuum generator operatively coupled to said vacuum roll for creating a suction pressure within an interior portion of said vacuum roll; and a motor for causing said vacuum roll to be rotatably driven at a substantially constant rate; and a control mechanism operatively coupled to said sensor and said sheet feeder, said control mechanism being adapted to cause said sheet feeder to remove said sheets from said accumulator station as long as the height of said stack of sheets is at least said minimum height as determined by said sensor, said control mechanism being adapted to cause said sheet feeder to cease removal of said sheets from said accumulator station if the height of said stack of sheets falls below said minimum height as determined by said sensor, said control mechanism comprising an actuator mechanism operatively coupled to said vacuum generator that selectively eliminates said suction pressure, in response to said signal generated by said sensor, while said vacuum roll is being rotatably driven by said motor.

2. An apparatus as defined in claim 1 wherein said vacuum generator comprises:

a vacuum pump;

a conduit pneumatically connecting said vacuum pump to said interior portion of said vacuum roll; and a valve operatively coupled to said conduit, said valve being capable of selectively closing said conduit in response to said signal generated by said sensor.

3. An apparatus as defined in claim 1 wherein said control mechanism comprises a pulse-shaping circuit operatively coupled to receive said signal from said sensor, said pulse-shaping circuit causing said sheet feeder to cease removal of said sheets from said accumulator station for a minimum period of time after the height of said stack of sheets falls below said minimum height as determined by said sensor.

4. An apparatus as defined in claim 1 wherein said control mechanism limits the rate at which said sheet feeder transitions between an on state in which said sheet feeder removes sheets from said accumulator station and an off state in which said sheet feeder does not remove sheets from said accumulator station.

5. An apparatus as defined in claim 1 wherein said control mechanism comprises a valve actuator.

6. An apparatus as defined in claim 1 wherein said transfer unit comprises a plurality of conveyor belts.

7. An apparatus as defined in claim 1 wherein said transfer unit comprises:

a first set of conveyor belts;

a second set of conveyor belts; and a support structure for supporting said first and second sets of conveyor belts, said support structure being adapted to cause a stream of sheets to be received between said first set of conveyor belts and a second set of conveyor belts.

8. An apparatus adapted to be used for the automatic handling of sheets from which leaflets are formed, said apparatus comprising:

a transfer unit for conveying sheets;

an accumulator station disposed adjacent said transfer unit, said accumulator station being adapted to receive sheets from said transfer unit and to accumulate said sheets in a stack;

a sensor associated with said accumulator station, said sensor being adapted to generate a signal indicative of whether the height of said stack of sheets in said accumulator station is at least a minimum height;

a sheet feeder being adapted to periodically remove sheets from said stack of sheets, said sheet feeder being adapted to remove sheets from said stack of sheets at a substantially constant rate, said sheet feeder comprising:

a rotatable vacuum roll adapted to remove a sheet from the bottom of said stack of sheets at said accumulator station;

a vacuum generator operatively coupled to said vacuum roll for creating a suction pressure within an interior portion of said vacuum roll; and a motor for causing said vacuum roll to be rotatably driven at a substantially constant rate; and a control mechanism operatively coupled to said sensor and said sheet feeder, said control mechanism being adapted to cause said sheet feeder to remove said sheets from said accumulator station as long as the height of said stack of sheets is at least said minimum height as determined by said sensor, said control mechanism being adapted to cause said sheet feeder to cease removal of said sheets from said accumulator station if the height of said stack of sheets falls below said minimum height as determined by said sensor, said control mechanism comprising an actuator mechanism operatively coupled to said vacuum generator that selectively eliminates said suction pressure, in response to said signal generated by said sensor, while said vacuum roll is being rotatably driven by said motor.

9. An apparatus as defined in claim 8 wherein said vacuum generator comprises:

a vacuum pump;

a conduit pneumatically connecting said vacuum pump to said interior portion of said vacuum roll; and a valve operatively coupled to said conduit, said valve being capable of selectively closing said conduit in response to said signal generated by said sensor.

10. An apparatus as defined in claim 8 wherein said control mechanism comprises a pulse-shaping circuit operatively coupled to receive said signal from said sensor, said pulse-shaping circuit causing said sheet feeder to cease removal of said sheets from said accumulator station for a minimum period of time after the height of said stack of sheets falls below said minimum height as determined by said sensor.

11. An apparatus as defined in claim 8 wherein said control mechanism limits the rate at which said sheet feeder transitions between an on state in which said sheet feeder removes sheets from said accumulator station and an off state in which said sheet feeder does not remove sheets from said accumulator station.

12. An apparatus as defined in claim 8 wherein said control mechanism comprises a valve actuator.

13. An apparatus as defined in claim 8 wherein said transfer unit comprises a plurality of conveyor belts.

14. An apparatus as defined in claim 8 wherein said transfer unit comprises:

a first set of conveyor belts;

a second set of conveyor belts; and a support structure for supporting said first and second sets of conveyor belts, said support structure being adapted to cause a stream of sheets to be received between said first set of conveyor belts and a second set of conveyor belts.

15. An apparatus adapted to be used for the automatic handling of sheets from which leaflets are formed, said apparatus comprising:

a transfer unit for conveying sheets;

an accumulator station disposed adjacent said transfer unit, said accumulator station being adapted to receive sheets from said transfer unit and to accumulate said sheets in a stack;

a sensor associated with said accumulator station, said sensor being adapted to generate a signal indicative of whether the height of said stack of sheets in said accumulator station is at least a minimum height;

a sheet feeder being adapted to periodically remove sheets from said stack of sheets, said sheet feeder comprising:

a rotatable vacuum roll adapted to remove a sheet from the bottom of said stack of sheets at said accumulator station;

a vacuum generator operatively coupled to said vacuum roll for creating a suction pressure within an interior portion of said vacuum roll; and a motor for causing said vacuum roll to be rotatably driven; and a control mechanism operatively coupled to said sensor and said sheet feeder, said control mechanism being adapted to cause said sheet feeder to remove said sheets from said accumulator station as long as the height of said stack of sheets is at least said minimum height as determined by said sensor, said control mechanism being adapted to cause said sheet feeder to cease removal of said sheets from said accumulator station if the height of said stack of sheets falls below said minimum height as determined by said sensor.

16. An apparatus as defined in claim 15 wherein said vacuum generator comprises a vacuum pump.

17. An apparatus as defined in claim 15 wherein said control mechanism comprises a pulse-shaping circuit operatively coupled to receive said signal from said sensor, said pulse-shaping circuit causing said sheet feeder to cease removal of said sheets from said accumulator station for a minimum period of time after the height of said stack of sheets falls below said minimum height as determined by said sensor.

18. An apparatus as defined in claim 15 wherein said control mechanism limits the rate at which said sheet feeder transitions between an on state in which said sheet feeder removes sheets from said accumulator station and an off state in which said sheet feeder does not remove sheets from said accumulator station.

19. An apparatus as defined in claim 15 wherein said control mechanism comprises a valve actuator.

20. An apparatus as defined in claim 15 wherein said transfer unit comprises a plurality of conveyor belts.

21. An apparatus as defined in claim 15 wherein said transfer unit comprises:

a first set of conveyor belts;

a second set of conveyor belts; and a support structure for supporting said first and second sets of conveyor belts, said support structure being adapted to cause a stream of sheets to be received between said first set of conveyor belts and a second set of conveyor belts.

22. An apparatus as defined in claim 15 wherein said accumulator station has a plurality of air-pressure apertures to supply pressurized air against a portion of said stack of sheets.

* * * * *